US009084043B2

(12) United States Patent
Shin

(10) Patent No.: US 9,084,043 B2
(45) Date of Patent: Jul. 14, 2015

(54) PRENATAL SOUND DELIVERY SYSTEM

(71) Applicant: David Shin, Brooklyn, NY (US)

(72) Inventor: David Shin, Brooklyn, NY (US)

( * ) Notice: Subject to any disclaimer, the term of this patent is extended or adjusted under 35 U.S.C. 154(b) by 157 days.

(21) Appl. No.: 14/048,387

(22) Filed: Oct. 8, 2013

(65) Prior Publication Data

US 2014/0037118 A1 Feb. 6, 2014

Related U.S. Application Data

(63) Continuation-in-part of application No. 12/757,176, filed on Apr. 9, 2010, now abandoned.

(51) Int. Cl.
*H04R 1/02* (2006.01)
*H04R 5/02* (2006.01)

(52) U.S. Cl.
CPC ..... *H04R 1/02* (2013.01); *H04R 5/023* (2013.01); *H04R 2201/023* (2013.01)

(58) Field of Classification Search
CPC .... H04R 2460/13; H04R 1/46; H04R 25/606; H04R 2499/11; H04R 17/00; H04R 2420/07
USPC ..... 381/151
See application file for complete search history.

(56) References Cited

U.S. PATENT DOCUMENTS

| | | | | |
|---|---|---|---|---|
| 4,934,998 | A * | 6/1990 | Thomas, Jr. | 600/27 |
| 5,491,756 | A * | 2/1996 | Francais | 381/332 |
| 5,873,736 | A * | 2/1999 | Harrison | 434/322 |
| 8,194,891 | B2 * | 6/2012 | Godart | 381/109 |
| 2009/0161892 | A1 * | 6/2009 | Servello et al. | 381/151 |

* cited by examiner

*Primary Examiner* — Mark Blouin
(74) *Attorney, Agent, or Firm* — Joseph S. Heino; Patrick M. Bergin

(57) ABSTRACT

A flexible and washable band is worn around the abdomen of an expectant woman. The band has waterproof speakers safely and comfortably integrated into an interior pocket of the band it to provide sound to prenatal babies. The speakers connect to an audio device that may be stored in an outer pocket of the band. A wire path is defined from the inner pocket to the outer pocket, the inner pocket completely containing the speakers except for a wire opening and the outer pocket comprising a wire opening and a device opening.

6 Claims, 3 Drawing Sheets

FIG. 1
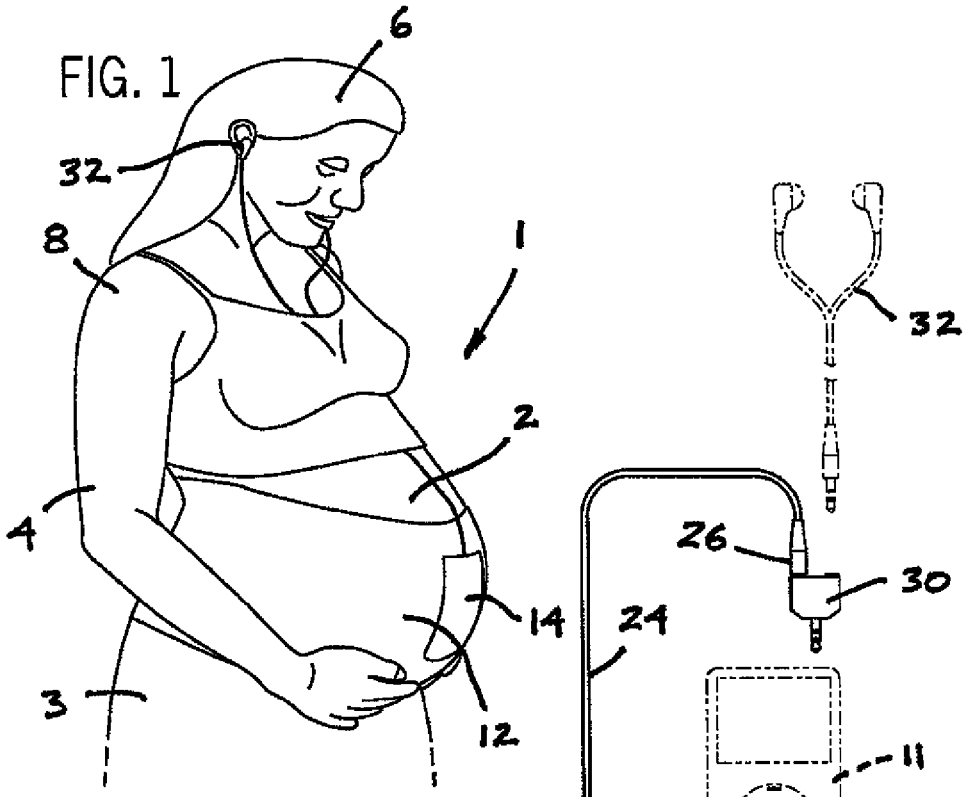
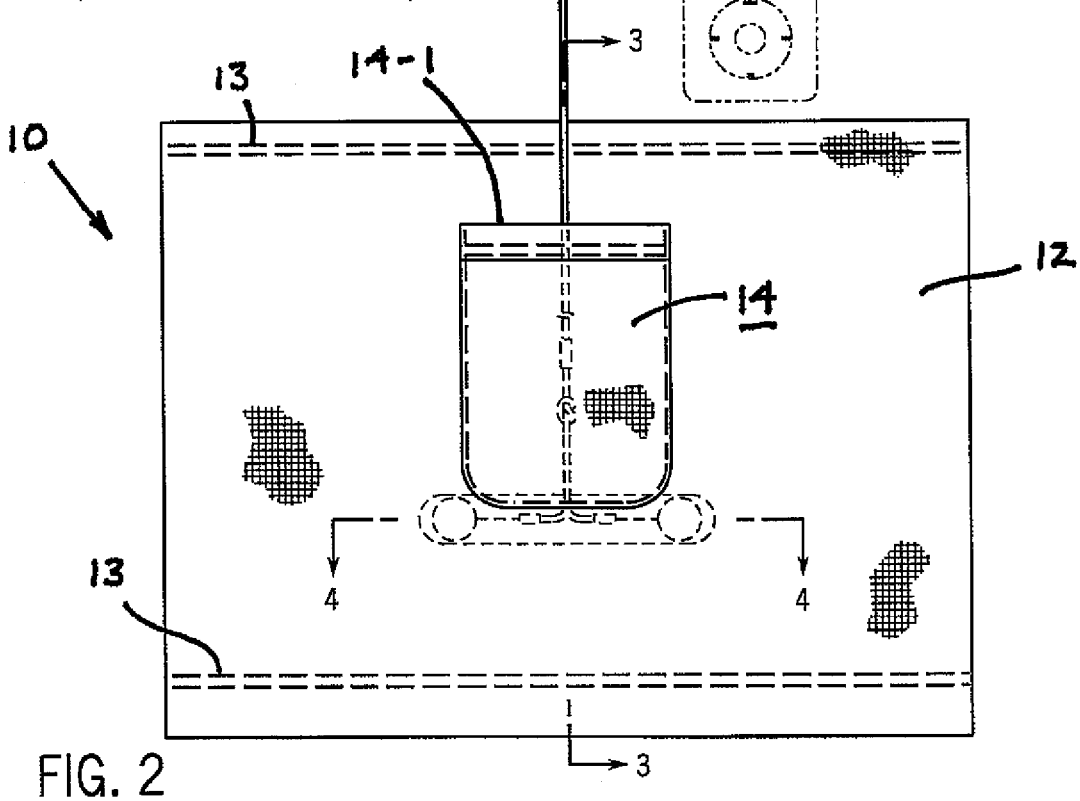
FIG. 2

PRENATAL SOUND DELIVERY SYSTEM

This application is a continuation-in-part of U.S. patent application Ser. No. 12/757,176 filed Apr. 9, 2010. The subject matter of that application is incorporated herein by reference.

FIELD OF THE INVENTION

The present invention relates to prenatal baby care and, more particularly, to an apparatus for safely and comfortably delivering sound to prenatal babies and/or to expectant mothers.

BACKGROUND OF THE INVENTION

The ear first appears in the 3rd week of gestation and it becomes functional by the 16th week. The fetus begins active listening by the 24th week. It is known from ultrasound observations that the fetus hears and responds to a sound pulse starting about 16 weeks of age. This is even before the ear construction is complete. The cochlear structures of the ear appear to function by the 20th week and mature synapses have been found between the 24th and 28th weeks. The sense of hearing is probably the most developed of all the senses before birth. The powerful connection between sound/music and prenatal memory/learning has been revealed in formal experiments, parental observations, clinical records, and first person reports.

As can be seen, there is a need for a safe and comfortable apparatus to deliver sound to prenatal babies.

SUMMARY OF THE INVENTION

In one aspect of the present invention, a prenatal sound system comprises a flexible band forming a vertically seamless and horizontally endless closed loop that is configured to fit around the abdomen of a user; at least one waterproof speaker integrated into the flexible band; a first pocket attached to an outer face of an outer layer of the flexible band for housing a portable sound playing device; and a wire for connecting the speakers to the portable sound playing device.

In another aspect of the present invention, a prenatal sound system comprises a flexible band forming a vertically seamless and horizontally endless closed loop that is configured to fit around the abdomen of a user; a first pocket attached to an outer face of an outer layer of the flexible band for housing a portable sound playing device; first and second waterproof speakers housed in a vinyl housing and integrated into a second pocket disposed between an inner layer and the outer layer of the flexible band; and a wire connecting to the speakers at a first end thereof, the wire adapted to electrically connect the speakers to the portable sound playing device.

These and other features, aspects and advantages of the present invention will become better understood with reference to the following drawings, description and claims.

BRIEF DESCRIPTION OF THE DRAWINGS

FIG. 1 is a perspective view of a sound delivery system according to an embodiment of the present invention showing the system as worn by an expectant woman.

FIG. 2 is a front elevational view of the sound delivery system of FIG. 1 and showing the system in an unworn position.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a band worn 12 around the stomach of a pregnant woman 1. See FIG. 1. The band 12 has at least one speaker safely and comfortably integrated therein to provide sound to a prenatal baby being carried by the woman 1.

Figure 3:
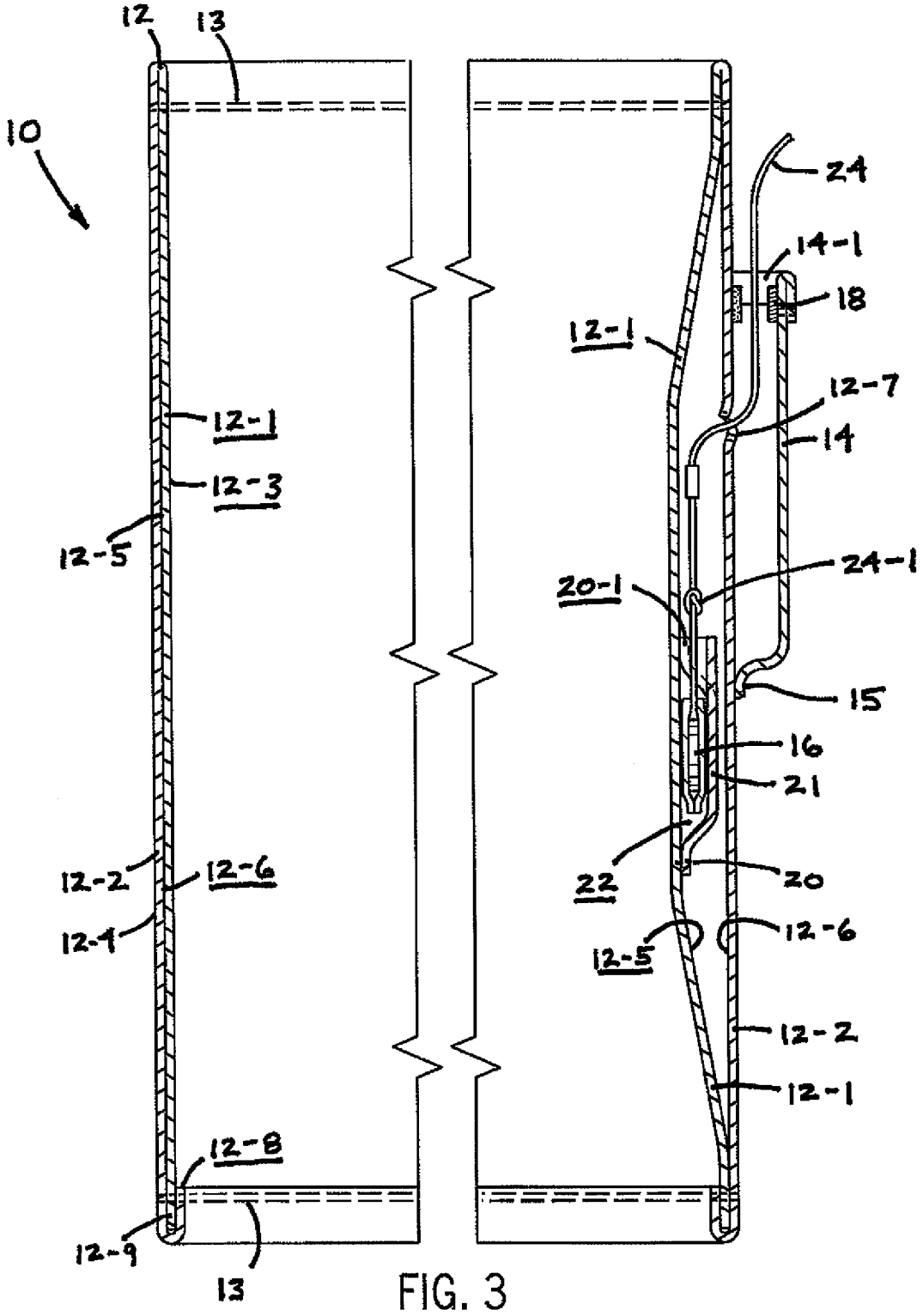
FIG. 3 is a partially cross-sectioned side elevational view of the sound delivery system taken along line 3-3 of FIG. 2.
Figure 4:
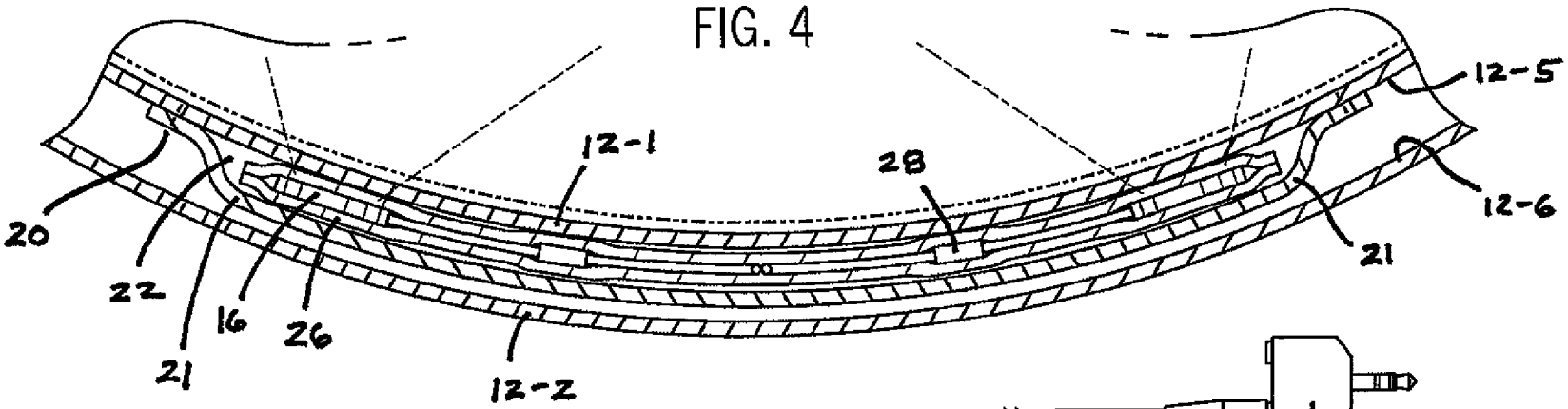
FIG. 4 is an enlarged and partially cross-sectioned top plan view of the sound delivery system taken along line 4-4 of FIG. 2.
Figure 5:
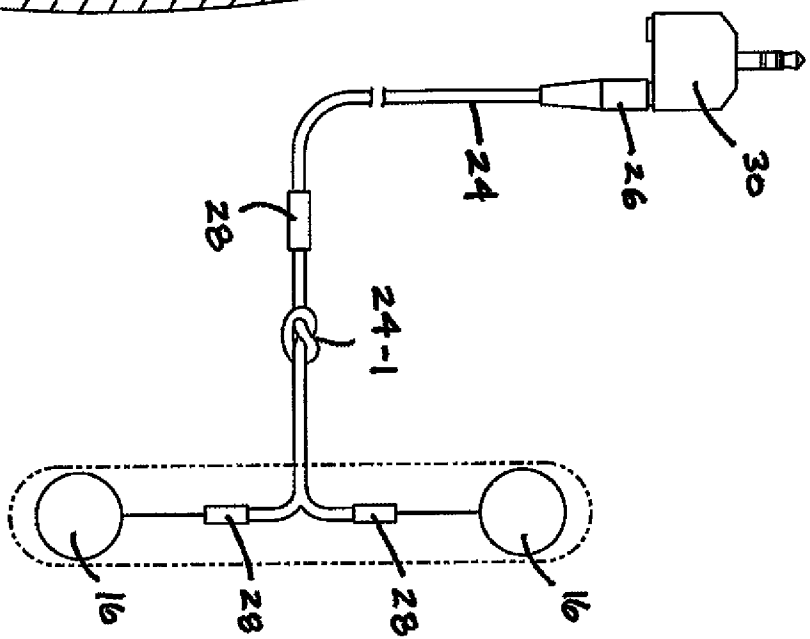
FIG. 5 is a front elevational view of the electronics portion of the sound delivery system of FIG. 1.

Referring to FIGS. 2 through 5, it will be seen that the band 12 is one element of the sound delivery system of the present invention, generally identified 10, which comprises the flexible band 12 and the flexible band 12 having an external pocket 14 attached thereto. The flexible band 12 is a single piece of material formed of Lycra® (Lycra is a registered mark of invista North America S.A.R.L.), spandex or any similar flexible material. The flexible band 12 is machine washable and has sufficient elasticity to stretch to fit a user. The flexible band 12 is formed by folding the band 12 over onto itself, thereby forming an inverted U-shaped structure that is stitched 13 together at the bottom ends 12-8, 12-9 of the band 12. Once folded over, the band 12 comprises an inner layer of material 12-1 and an outer layer 12-2 of flexible material, respectively. See FIG. 3. Stitching is also used at the top of the band 12.

The inner layer 12-1 of the band 12 comprises an inner face 12-3 that is positioned immediately adjacent the woman's abdomen 2 and an outer face 12-5. Similarly, the outer layer 12-2 of the band 12 comprises an outer face 12-4 and an inner face 12-6 when the continuous flexible band 12 is worn as intended. As configured, the outer face 12-5 of the inner layer 12-1 is juxtaposed to the inner face 12-6 of the outer layer 12-2. See FIG. 3.

The flexible band 12 is a closed loop that is configured such that a user can step into the continuous flexible band 12 and pull it upwardly over her legs and hips 3, or could be pulled downwardly over her arms 4, head 6 and shoulders 8, although the former approach is much preferred by this inventor.

Referring again to FIG. 2, it will again be noted that the continuous flexible band 12 forms a vertically seamless and horizontally endless closed loop structure. This continuous flexible band 12 is a structure that further comprises a uniform height about the periphery of the band 12, which allows for added comfort and back support for the user 1.

A first, or outer, pocket 14 is formed from a third layer of material that is permanently attached to the outer face 12-4 of the outer layer 12-2 of the continuous flexible band 12 by conventional means. For example, the pocket 14 has a perimeter and is stitched 15 to the outer face 12-4 of the outer layer 12-2. The pocket 14 is sized to hold a portable sound playing device, such as an MP3 player 11, which is shown in phantom view in FIG. 2. The pocket 14 further has a top opening 14-1 and a closure material 18 disposed at the top of the pocket 14, such as a hook and loop fastener (Velcro® for example (Velcro is a registered mark of Velcro Industries B.V.)), to prevent the music playing device 11 from inadvertently falling out of the pocket 14 during use and to hold a wire 24, or the wire 24 and a connector 26, during machine or hand washing, although removal of the connector 26 is preferred prior to washing.

The flexible band 12 comprises at least one waterproof mini-speaker 16. In a typical embodiment, two mini-speakers 16 are disposed within a second, or inner, pocket 22, the second pocket 22 being formed by a fourth layer of material that is permanently attached to the outer face 12-5 of the inner layer 12-1 and further being disposed between the inner and outer layers 12-1, 12-2, respectively, of the band 12. The second pocket 22 is formed by permanently securing the fourth layer of material 21 to the outer face 12-5 of the inner layer 12-1 by stitching 20. The mini-speakers 16 may be a conventional design but must be waterproof since they are not configured to be removed or removable from the band 12. See FIG. 4.

The mini-speakers 16 may have a metal housing and the magnet used may be neodymium (Nd) magnets. The mini-speakers 16 may weigh from about 1.5 to about 2.5 grams, typically about 1.8 grams. The mini-speakers 16 may use a voltage between about 0.2 to about 0.5 watts with a maximum decibel level (dBA) of about 88 sound pressure. The voltage may be selected to allow the speakers 16 to run without a separate power source and without draining an independently powered sound device. The speakers 16 may have low heat output to ensure the safety and comfort of the user. Alternate designs for the speakers 16 may be available. As examples of alternate designs, the speakers 16 may have a plastic housing 26, a paper cone, or may use neodymium-iron-boron (Nd—Fe—B) magnets. The stitching 20 creates an inner pocket 22 to limit movement of the speakers 16 between the inner and outer layers 12-1, 12-2. See FIG. 4.

The speakers 16 are permanently secured within the second or inner pocket 22 as previously described. The speakers 16 are electrically attached to a wire 24. The wire 24 leading from the speakers 16 is fed through an opening 22-1 that is defined within a small gap 20-1 in the stitching 20 of the inner pocket 22. From there, the wire 24 is knotted 24-1 to allow the wire 24 to pass through the outer layer 12-1 via an opening 12-7 that is defined behind the first pocket 14 and that then leads the wire 24 to the pocket 14 attached to the outer face 12-4 of the outer layer 12-1 and to prevent it from passing through the opening 12-7. See FIG. 3.

The wire 24 has a connector 26 at the opposite end thereof. See FIG. 5. The connector 26 may be, for example, a ⅛" male stereo connector. The connector 26 may include a female stereo connector 30 to allow the user to attach external speakers (shown in phantom view in FIG. 2), such as headphones or ear buds 32, so that she is able to listen to the same sounds as the prenatal baby. See also FIG. 1. The wire 24 may be an insulated braided copper wire, for example. The wire 24 may be long enough to allow the connector 26 to extend from the pocket 14 of the flexible band 12.

The wire 24 may include at least one resistor 28 in series between the connector 26 and the speakers 16. The resistor 28 may limit the number of decibels allowed through the speakers to, for example, about 75 dBA. A variety of resistors 28 may be used to coordinate with the selected speakers 16, depending on the wattage of the chosen speakers.

The speakers 16 may be covered with a casing 26 such as vinyl A vinyl casing on the speakers 16 may help cover, insulate and make them moisture proof such that the band 12 is washable. See FIG. 4.

It should be understood, of course, that the foregoing relates to exemplary embodiments of the invention and that modifications may be made without departing from the spirit and scope of the invention as set forth in the following claims.

The details of the invention having been disclosed in accordance with the foregoing, I claim:

1. A prenatal sound system comprising:

a continuous flexible band forming a vertically seamless and horizontally endless closed loop, the flexible band being configured to fit around an abdomen of a user, the flexible band comprising two opposing layers of flexible material, the flexible band further comprising an inner layer that extends all of the way around the band, the inner layer comprising an inner face that is positioned adjacent the user's abdomen and an outer face, and an outer layer that also extends all of the way around the band, the outer layer comprising an inner face and an outer face, the outer face of the inner layer being juxtaposed with the inner face of the outer layer, and the flexible band further comprising a uniform height at all points about the loop and fully around the inner layer and the outer layer of the flexible band without folding any portion of the band over onto another portion of the band;

a first pocket formed by a third layer of material that is attached to the outer face of the inner layer, the pocket having a perimeter and the first pocket being formed by uninterrupted stitching about the perimeter of the third layer of material except at a single point where the stitching is interrupted and such interruption forms an opening to the first pocket;

at least one speaker integrated into the flexible band, the at least one speaker being permanently positioned between the opposing layers of the flexible band housed within the first pocket;

a second pocket formed by a fourth layer of material that is affixed to the outer face of the outer layer of the flexible band for housing an electronic portable sound playing device within that second pocket;

an opening formed within the outer layer of the band and behind the second pocket; and a permanently positioned electrical conduction wire, the wire electrically connecting forming an electrical connection between the sound playing device to the at least one speaker by passing from the at least one speaker, through the opening of the first pocket, through the opening behind the second pocket and to the sound playing device housed within that second pocket.

2. The prenatal sound system of claim 1, wherein the at least one speaker is two speakers.

3. The prenatal sound system of claim 1, wherein the at least one speaker is housed within a vinyl casing.

4. The prenatal sound system of claim 1, further comprising at least one resistor to control the decibel level of the at least one speaker to a predetermined maximum.

5. The prenatal sound system of claim 1, wherein the at least one speaker is waterproof.

6. The prenatal sound system of claim 1, further comprising:

the wire further comprising a first end and a second end, the first end being connected to the at least one speaker and the second end being connected to the portable sound playing device; and a connector at the second end of the wire, the connector comprising a female connector adapted to connect an external speaker to the portable sound playing device.

* * * * *